US005738540A

United States Patent [19]

Hetherington

[11] Patent Number: 5,738,540

[45] Date of Patent: Apr. 14, 1998

[54] APPARATUS FOR COUPLING A DEVICE TO AN ELECTRICAL RECEPTACLE

[76] Inventor: Michael Warnett Hetherington, R.R. 1, Mount Albert, Ontario, Canada, L0G 1M0

[21] Appl. No.: 457,687

[22] Filed: Jun. 1, 1995

[51] Int. Cl.[6] ..... H01R 13/60

[52] U.S. Cl. ..... 439/536; 439/173; 439/929; 174/66

[58] Field of Search ..... 439/170–173, 439/164, 446, 640, 13, 18–22, 144, 147, 929, 536, 537; 174/66

[56] References Cited

U.S. PATENT DOCUMENTS

| | | | |
|---|---|---|---|
| 2,611,068 | 9/1952 | Wellens | 439/173 |
| 4,228,343 | 10/1980 | Kanner et al. | 439/18 |
| 4,625,259 | 11/1986 | Krechmer et al. | 439/173 |
| 4,952,157 | 8/1990 | Hudson et al. | 439/537 |
| 5,049,086 | 9/1991 | Slaven | 439/144 |
| 5,352,122 | 10/1994 | Speyer et al. | 439/13 |
| 5,366,187 | 11/1994 | Ishihara | 439/446 |
| 5,376,020 | 12/1994 | Jones | 439/537 |
| 5,399,093 | 3/1995 | Schneider et al. | 439/21 |
| 5,517,264 | 5/1996 | Sutton | 353/119 |
| 5,551,882 | 9/1996 | Whiteman, Jr. et al. | 439/446 |

*Primary Examiner*—Neil Abrams
*Assistant Examiner*—Brian J. Biggi
*Attorney, Agent, or Firm*—Ridout & Maybee

[57] ABSTRACT

A rotatable and interchangeable electrical plug for an electronic device which plugs directly into a receptacle. The electronic device comprises an enclosure with a socket for receiving the plug. The plug includes a detent which fits into one or more indents in the socket for determining the orientation of the plug. The plug can also be rotated in the socket to positions defined by the indents, which allows the orientation of the electronic device to be changed once plugged into the receptacle. In another aspect, the receptacle cover includes a safety catch which is engaged when the device is rotated to a lock position. In another aspect, the electronic device is fastened to a plate, the plate being received in a slot in the receptacle cover.

4 Claims, 4 Drawing Sheets

APPARATUS FOR COUPLING A DEVICE TO AN ELECTRICAL RECEPTACLE

FIELD OF THE INVENTION

This invention relates to apparatus for coupling a device to an electrical receptacle, and more specifically to an interchangeable and rotatable electrical plug and a housing having a safety catch.

BACKGROUND OF THE INVENTION

Electrical devices which plug directly into an electrical outlet are widely used. For example, there are well-known devices such as DC power supplies and carbon monoxide detectors which plug directly into an electrical wall receptacle or outlet. Such devices comprise an enclosure or housing which holds the circuit and an electrical plug which is inserted into the outlet.

In the prior art devices, the plug is permanently fled to the housing. Typically, the housing is moulded from plastic and the electrical prongs are inserted during moulding. While this arrangement is widely used, it has certain disadvantages. First, because the plug is permanently attached to the housing, any change in the outlet standard means that the housing piece, e.g. backplate, containing the plug must be replaced. Because the outlet standards can vary from country to country, housings must be manufactured on the basis of the electrical standard and plug configuration for each country of market interest. It will be appreciated that this increases production and inventory control costs. Secondly, because the electrical plug is permanently attached to the housing, the orientation of the outlet determines the orientation of the device once it is plugged into the outlet. Because some devices will not operate properly unless mounted in a certain orientation, it becomes necessary to manufacture a separate housing in which the electrical prongs are arranged according to the receptacle orientation, for example 90° to the normal.

Accordingly, there is a need for an electrical plug which is adjustable to accommodate the configuration or orientation of the outlet. There is a need for a plug which is easily replaceable to provide compatibility with different electrical plug standards. There is also a need for a plug and receptacle arrangement which provides a safety catch to prevent removal of a device plugged in the receptacle.

BRIEF SUMMARY OF THE INVENTION

In a first aspect, the present invention provides an electrical plug for an electronic device mounted by directly plugging into a receptacle and the device having an enclosure for an electronic circuit and including a socket for receiving said electrical plug, said plug comprising: (a) a plug body having one or more slots for receiving respective electrical conductors compatible with the receptacle and for coupling to said electronic circuit; (b) means for fastening said plug body to said enclosure; (c) said plug body having a shape adapted for fitting the socket in said enclosure and said socket including an indent for positioning said plug; and (d) said plug body including a detent adapted to fit said indent for determining the position of said plug in the socket.

In a second aspect, the present invention provides an electronic device mounted by plugging into a wall receptacle, said device comprising: (a) a plug having electrical conductors compatible with the standard of said receptacle; (b) an enclosure for housing an electronic circuit, said enclosure including a socket for receiving said plug; (c) means for fastening said plug to said enclosure; (d) said socket including an indent for positioning said plug; and (e) said plug including a detent adapted to fit said indent for determining the position of said plug in said socket.

In another aspect, the present invention provides an apparatus for mounting an electronic device to an electrical box, said apparatus comprising: (a) a plate having means for fastening to said electronic device; (b) a receptacle cover having means for coupling to said electrical box; (c) said receptacle cover having means for receiving said plate and means for engaging said plate in a lock position; and (d) said plate having actuating means for disengaging said plate from said lock position so that said plate and said electronic device fastened to said plate are removable from said receptacle cover.

BRIEF DESCRIPTION OF THE DRAWINGS

Reference will now be made to the accompanying drawings which show, by way of example, preferred embodiments of the present invention, and in which:

FIG. 1(*b*) is a top view of the electrical plug of FIG. 1(*a*);

FIG. 5(*b*) is a view of the electrical receptacle of FIG. 5(*a*) mounted 90° to normal;

FIG. 7(*b*) is a top view of the plug and receptacle cover arrangement of FIG. 7(*a*);

FIG. 8(*b*) is cross-sectional view of the arrangement in FIG. 8(*a*) taken through line B—B.

DETAILED DESCRIPTION OF THE PREFERRED EMBODIMENTS

Reference is made to FIGS. 1 to 5 which show an electrical plug 1 and electronic box 2 according to the present invention. The electrical plug 1 shown in FIGS. 1(*a*) and 1(*b*) is intended for use with the electronic housing or box 2 shown FIG. 2. The electronic housing 2 provides an enclosure for various known devices such as carbon monoxide detectors and air purifiers.

Figure 5B:
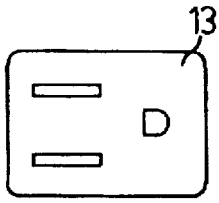
FIG. 5(*a*) is a view of an electrical outlet or receptacle mounted in a normal orientation.
Figure 5A:
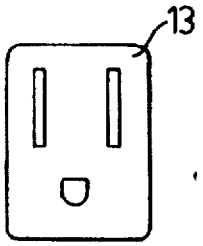
Figure 8A:
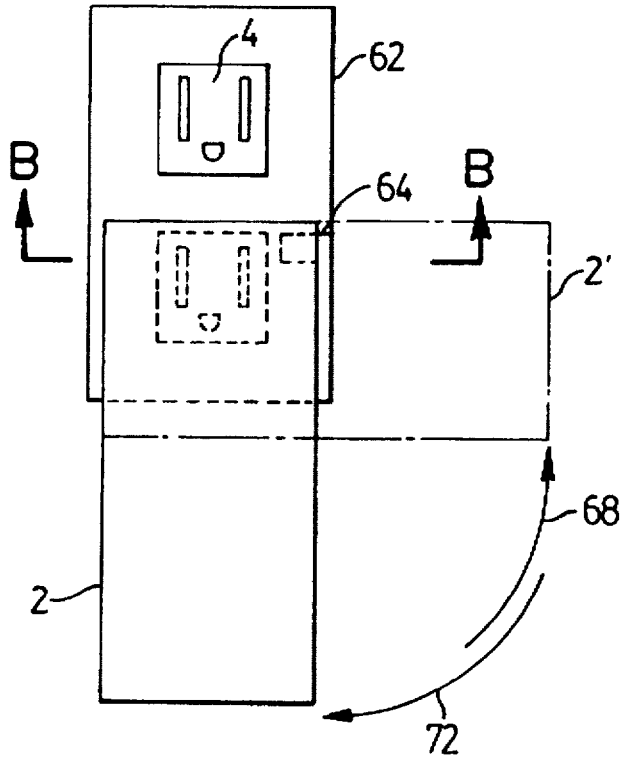
FIG. 8(*a*) shows an electrical housing with a safety lock feature according to the present invention.
Figure 8B:
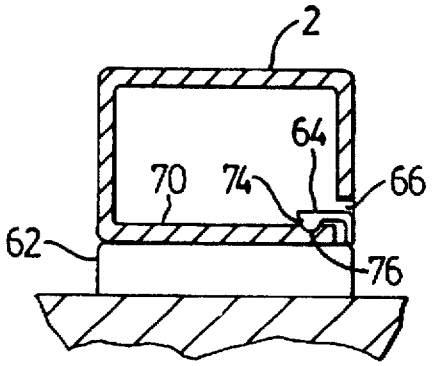

It is a feature of the present invention that the electrical plug 1 can be mounted in various orientations in the housing 2. For example, an electrical plug 1 and box 2 according to the invention can be used without modification with an electrical receptacle 13 installed in a normal position as shown in FIG. 5(*a*) and also with an receptacle 13 installed 90° to normal as shown in FIG. 5(*b*). In another aspect of the present invention, the plug 1 is turnable in the housing 2 so that the orientation of the housing 2 with respect to the receptacle 13 can be changed with the plug 1 inserted in the receptacle 13 by simply turning the housing 2 for example 90° as shown in FIG. 8(*a*). This allows the electrical housing 2, i.e device, to be mounted in a vertical position for example regardless of the orientation of the electrical receptacle 13.

The electrical plug 1 comprises a body 4 and one or more electrical conductors or prongs 6 and 8. The body 4 of the plug 1 is preferably moulded as a single piece unit and includes slots 10 and 12 for receiving the electrical prongs 6,8. The arrangement of the electrical prongs 6,8 is determined by the standard for the electrical receptacle. In North America, for example, a standard receptacle comprises two flat prongs (and a rounded ground prong) as depicted in FIG. 5. It is a feature of the present invention that electrical plugs 1 with different prong configurations can be manufactured and stocked for installation in electronic boxes or enclosures 2 destined for various markets or countries. This alleviates the need to manufacture boxes 2 specific to the receptacle configuration or standard. Because the plug 1 is a separate component from the housing 2, the plug 1 can also be manufactured very inexpensively and in large volume, for example, using a vertical moulding machine with a rotary table. Such an arrangement also allows the use of an automatic pin feeding system for inserting the prongs which further reduces the costs associated with manufacturing a plug according to the present invention.

Figure 1B:
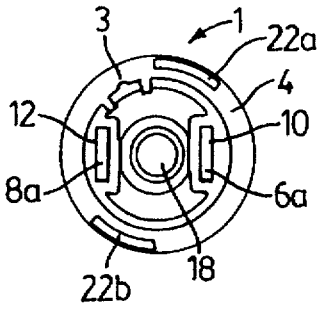
FIG. 1(*a*) is a side view of an electrical plug according to the invention.
Figure 1A:
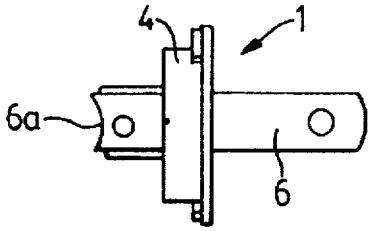

Referring to FIG. 1, one end denoted by reference 6*a* of the prong 6 is coupled to an electronic circuit 7 (shown in broken outline in FIG. 2) mounted inside the box 2. The other end of the prong 6 is intended for plugging into the receptacle 4. The terminal end 6*a* of the prong 6 is connected to the electronic circuit 7 using a "push-on" terminal or other suitable known connector.

Figure 2:
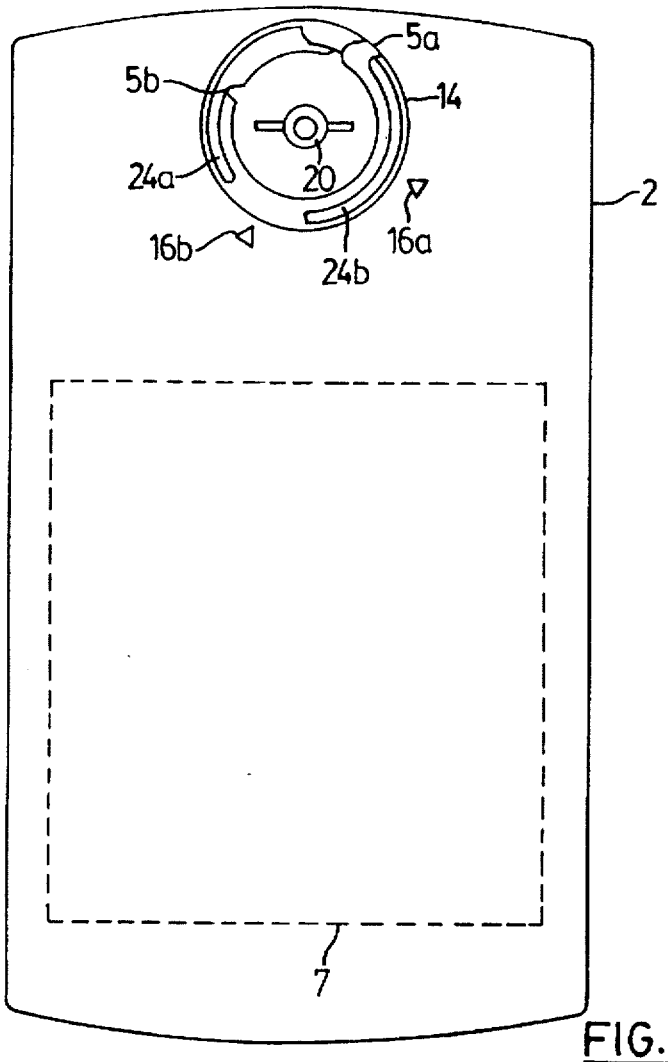
FIG. 2 is a view of an electronic housing having a receptacle suitable for mounting the plug of FIG. 1.

As shown in FIG. 2, the electrical housing 2 includes a socket 14 for receiving the electrical plug 1. The socket 14 can be moulded as part of the box 2 as shown in the cross-sectional view of FIG. 4. The plug 1 is dropped into the socket 14 and the orientation of the plug 1 is determined by a detent 3 which fits into one of two indents or grooves 5*a* or 5*b*. In the present embodiment, the indents 5*a*,5*b* are configured to allow the plug 1 to be rotated to 90° to the normal for the receptacle 4 configurations shown in FIG. 5. For assembly purposes, the housing 2 can include orientation markings 16*a*,16*b* which are aligned with corresponding markings (not shown) on the exterior surface of the plug 1.

The plug 1 can be fastened to the housing 2 using a screw. The body 4 of the plug 1 includes a screw hole 18 (FIG. 1(*b*)). When the plug 1 is positioned in the socket 14, the screw hole 18 aligns with a standoff 20 (for example moulded into the base of the housing 2) and a screw (not shown) is screwed into the standoff 20. To facilitate positioning the plug 1 in the socket 14, the plug 1 is provided with a pair of tongues 22*a*,22*b* which It into corresponding grooves 24*b*,24*a* in the socket 14. The arrangement of the tongues 22*a*,22*b* and grooves 24*a*,24*b* also provides a guide or track to facilitate rotating or turning the plug 1 when seated in the socket 14. For the arrangement shown in FIG. 2, the plug 1 is rotatable between the first position 16*a* and the second position 16*b* or vice versa. The tongues 22*a*,22*b* can be moulded into the body 4 of the plug 1. Similarly, the grooves 24*a*,24*b* can be moulded into the socket 14. Because the box 2 can be moulded without the pins or prongs inserted as required for prior art devices, the box 2 can be manufactured using fully automated machines which further reduces the cost of production.

Figure 6:
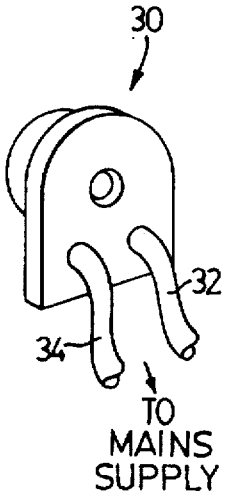
FIG. 6 shows another embodiment of an electrical plug according to the present invention.
Figure 3:
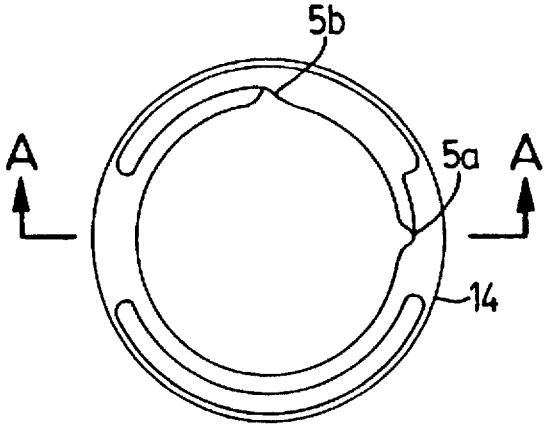
FIG. 3 is a more detailed view of the receptacle shown in FIG. 2.
Figure 4:
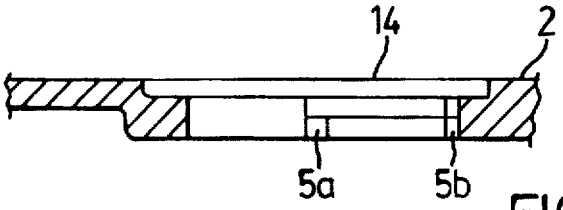
FIG. 4 is a sectional view taken along line A—A of FIG. 3.

In another embodiment of the present invention, the electrical plug 1 is replaced by a plug 30 as shown in FIG. 6. The plug 30 allows the electronic box 2 (i.e. device) to be hard wired into the mains supply. As shown in FIG. 6, the plug 30 includes two (or more) wires 32,34 which are connected to the mains. The plug 30 has a hole 36 for receiving a screw (not shown). For this embodiment, the socket 14 and plug 30 need not include the indents 5*a*,5*b* and detent 3 if the turnable feature is not required.

Figure 7A:
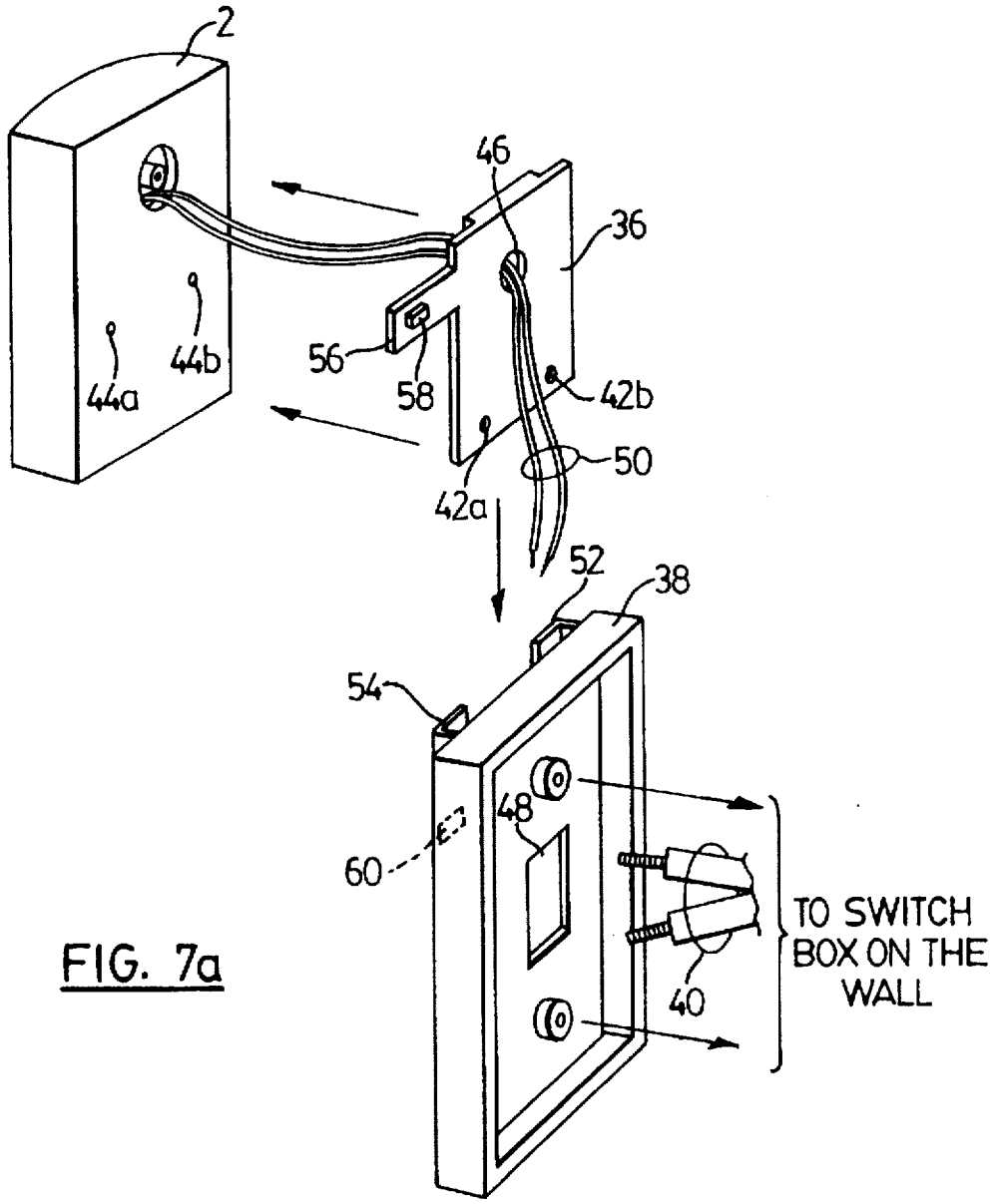
FIG. 7(*a*) shows another embodiment of a plug and a receptacle cover according to the present invention.
Figure 7B:
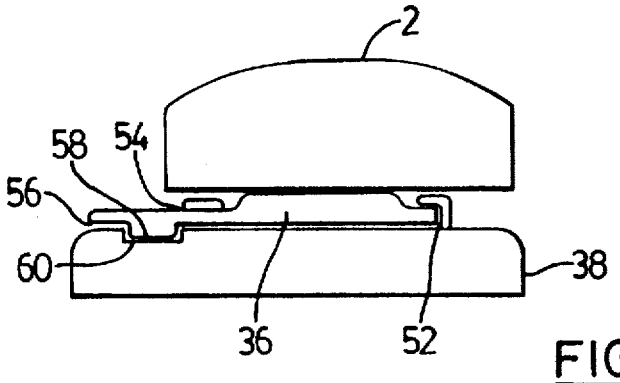

Reference is made to FIGS. 7(*a*) and 7(*b*) which show another embodiment of a plug or plate 36 for attaching the housing 2 to a wall receptacle 4. As shown in FIG. 7(*a*), the plug 30 (FIG. 6) is replaced by a plate 36 and receptacle cover 38. The receptacle cover 38 is fastened to a conventional switch box (not shown) mounted in a wall and connected to the mains supply. (For an octagon type switch box (not shown), the plate 36 is preferably round in shape.) The plate 36 connects to the back of the housing 2 and couples the housing 2 to the receptacle 38 and mains supply shown as two leads 40 in FIG. 7(*a*). The plate 36 includes fastening means, i.e. screw holes 42*a*,42*b* which communicate with corresponding screw holes 44*a*,44*b* in the housing 2. The plate 36 also includes an aperture 46 which registers with the socket 14 in the housing 2 and an aperture 48 in the receptacle cover 38 to provide a conduit for wires 50 from the electronic circuit inside the housing 2.

As shown in FIGS. 7(*a*) and 7(*b*), the receptacle cover 38 includes a pair of channels or slots 52,54 which can be formed into the receptacle cover 38. The channels 52,54 are sized to receive the plate 36 and allow the plate 36 (with the wires 50) to be seated into position with respect to the opening 48. To lock the plate 36 and housing 2 into position, the plate 36 includes a locking arm 56. The locking arm 56 has a detent 58 which snaps into a corresponding indent 60 when the plate 36 is seated into position in the receptacle cover 38. The indent 60 can be formed into receptacle cover 38.

Reference is next made to FIGS. 8(*a*) and 8(*b*) which show another embodiment of the turnable plug 1 and electronic housing 2 arrangement comprising a receptacle cover 62 having a safety catch 64. According to this aspect of the invention, the housing 2 includes an opening 66 which receives the safety catch 64 when the housing 2 is plugged into the receptacle 4 and rotated 90° into a lock position as indicated by arrow 68. In the lock position 68, the safety catch 64 engages the inside of the back wall 70 of the housing 2 and prevents the device 2 from being pulled out of the receptacle 4. To disengage the safety catch 64, the housing 2 is simply rotated in the opposite direction to the unlocked position as indicated by arrow 72, which in FIG. 8(*a*) corresponds to a vertical position for the device 2.

The arrangement shown in FIGS. 8(*a*) and 8(*b*) provides a safety feature which is desirable, for example, in a room where small children may be present. The safety catch 64 can be formed with a detent 74 which snaps into a reciprocal indent 76 formed in the wall 70 of the housing 2.

The present invention may be embodied in other specific forms without departing from the spirit or essential characteristics thereof. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

I claim:

1. An apparatus for mounting an electronic device to an electrical box, said apparatus comprising:

(a) a plate having means for fastening to said electronic device;

(b) a receptacle cover having means for coupling to said electrical box;

(c) said receptacle cover having means for receiving said plate and means for engaging said plate in a lock position; and (d) said plate having actuating means for disengaging said plate from said lock position so that said plate and said electronic device fastened to said plate are removable from said receptacle cover.

2. The apparatus as claimed in claim 1, wherein said means for receiving said plate comprises a slot being adapted to fit said plate.

3. The apparatus as claimed in claim 1, wherein said means for engaging comprises an indent in said receptacle cover and a detent in said plate, and said detent registering with said indent when said plate is moved to said lock position.

4. The apparatus as claimed in claim 3, wherein said disengaging means comprises an arm on said plate movable to an unlock position for disengaging said detent from said indent.

* * * * *